US010743116B2

(12) United States Patent
Rabel

(10) Patent No.: US 10,743,116 B2
(45) Date of Patent: Aug. 11, 2020

(54) SMALL LOOP ANTENNA WITH SHORTING CONDUCTORS FOR HEARING ASSISTANCE DEVICES

(71) Applicant: Starkey Laboratories, Inc., Eden Prairie, MN (US)

(72) Inventor: Jay Rabel, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/074,027

(22) Filed: Nov. 7, 2013

(65) Prior Publication Data

US 2014/0321685 A1 Oct. 30, 2014

Related U.S. Application Data

(60) Provisional application No. 61/817,755, filed on Apr. 30, 2013.

(51) Int. Cl.
*H04R 25/00* (2006.01)
*H01Q 7/00* (2006.01)
(Continued)

(52) U.S. Cl.
CPC ..... *H04R 25/554* (2013.01); *H01Q 1/273* (2013.01); *H01Q 1/44* (2013.01); *H01Q 7/00* (2013.01);
(Continued)

(58) Field of Classification Search
CPC ..... H04R 25/554; H04R 2225/51; H04R 2225/49; H01Q 7/00; H01Q 1/243;
(Continued)

(56) References Cited

U.S. PATENT DOCUMENTS 3,560,983 A * 2/1971 Willie ..... 343/744
7,450,078 B2 11/2008 Knudsen et al.
(Continued)

FOREIGN PATENT DOCUMENTS

DE 10247543 A1 * 4/2003
EP 1555717 A1 7/2005
(Continued)

OTHER PUBLICATIONS

"European Application Serial No. 14166610.7, Extended European Search Report dated Oct. 15, 2014", 7 pgs.
(Continued)

*Primary Examiner* — Norman Yu
(74) *Attorney, Agent, or Firm* — Schwegman Lundberg & Woessner, P.A.

(57) ABSTRACT

Disclosed herein, among other things, are methods and apparatus for mitigating antenna interference for hearing assistance devices. One aspect of the present subject matter includes a hearing aid for a wearer including hearing aid electronics and an antenna including a loop segment. According to various embodiments, one or more conductors are connected in parallel with a portion of the loop segment. The conductors electrically short the loop segment to change current distribution in the antenna. The conductors reduce unwanted coupling between the hearing aid electronics and the antenna, according to various embodiments.

19 Claims, 4 Drawing Sheets

(51) Int. Cl.
*H01Q 1/27* (2006.01)
*H01Q 1/44* (2006.01)

(52) U.S. Cl.
CPC ..... *H04R 2225/49* (2013.01); *H04R 2225/51* (2013.01); *Y10T 29/49016* (2015.01)

(58) Field of Classification Search
CPC ..... H01Q 1/245; H01Q 11/08; H01Q 1/36; H01Q 23/00; H01Q 1/52; H01Q 5/385; H01Q 9/0421; H01Q 3/00; H01Q 9/04
USPC ..... 381/324, 315, 23.1, 322, 384; 343/866, 343/744, 745, 833, 748, 777, 818, 860
See application file for complete search history.

(56) References Cited

U.S. PATENT DOCUMENTS

| | | | | |
|---|---|---|---|---|
| 7,593,538 | B2 | 9/2009 | Polinske | |
| 7,830,325 | B2 | 11/2010 | Qi et al. | |
| 8,180,080 | B2 | 5/2012 | Polinske et al. | |
| 2003/0071757 | A1* | 4/2003 | Yamaki | H01Q 1/243 343/741 |
| 2005/0099341 | A1* | 5/2005 | Zhang et al. | 343/700 MS |
| 2006/0227989 | A1* | 10/2006 | Polinske | 381/322 |
| 2009/0051612 | A1* | 2/2009 | Shimizu | H01Q 9/14 343/748 |
| 2010/0074461 | A1 | 3/2010 | Polinske | |
| 2010/0158293 | A1* | 6/2010 | Polinske | H01Q 1/243 381/315 |
| 2010/0220030 | A1* | 9/2010 | Shimoda et al. | 343/860 |
| 2011/0316750 | A1* | 12/2011 | Yen | H01Q 1/245 343/702 |
| 2012/0308058 | A1 | 12/2012 | Polinske | |
| 2013/0223664 | A1* | 8/2013 | Meskens et al. | 381/315 |

FOREIGN PATENT DOCUMENTS

| | | | |
|---|---|---|---|
| EP | 1808929 | B1 | 9/2009 |
| EP | 2200120 | A2 | 6/2010 |
| EP | 2285138 | B1 | 2/2011 |
| EP | 1708306 | B1 | 5/2012 |
| EP | 2458674 | * | 5/2012 |
| EP | 2458674 | A2 | 5/2012 |
| WO | WO-2011000416 | A1 | 1/2011 |

OTHER PUBLICATIONS

"European Application Serial No. 14166610.7, Communication Pursuant to Article 94(3) EPC dated Sep. 4, 2019", 6 pgs.

* cited by examiner

SMALL LOOP ANTENNA WITH SHORTING CONDUCTORS FOR HEARING ASSISTANCE DEVICES

CLAIM OF PRIORITY AND INCORPORATION BY REFERENCE

The present application claims the benefit of priority under 35 U.S.C. §119(e) of U.S. Provisional Patent Application No. 61/817,755, filed Apr. 30, 2013, the disclosure of which is hereby incorporated by reference herein in its entirety.

TECHNICAL FIELD

This document relates generally to hearing assistance systems and more particularly to methods and apparatus for small loop antennas with shorting conductors for hearing assistance devices.

BACKGROUND

Modern hearing assistance devices, such as hearing aids, are electronic instruments worn in or around the ear that compensate for hearing losses by specially amplifying sound. Some hearing aids include an antenna for radio frequency communications. Wearers of hearing aids can experience problems with antenna communication. Examples include, but are not limited to, unwanted coupling between the antenna and other hearing aid components which causes artifacts, noise and interference. To limit this unwanted coupling, previous methods have included shielding or moving components farther away from the antenna to reduce unwanted coupling and reducing the physical aperture of the antenna for harmonic response and impedance improvements. However, adding shielding increases the part-count, adds assembly complexity, can degrade wireless performance and may increase the size of the hearing aid. Likewise, moving components farther away from the antenna increases the minimum size of the hearing aid. In addition, reducing the antenna physical aperture size usually reduces radiation efficiency and degrades performance.

Accordingly, there is a need in the art for improved systems and methods for improving antenna performance for hearing assistance devices.

SUMMARY

Disclosed herein, among other things, are methods and apparatus for mitigating antenna interference for hearing assistance devices. One aspect of the present subject matter includes a hearing assistance device, such as a hearing aid, for a wearer including hearing aid electronics and an antenna including a loop segment. According to various embodiments, one or more conductors are connected in parallel with a portion of the loop segment. The conductors electrically short the loop segment to change current distribution in the antenna. The conductors are configured to reduce unwanted coupling between the hearing aid electronics and the antenna, according to one embodiment. The conductors are configured to increase desired coupling, adjust antenna frequency response, adjust electromagnetic field distribution, reduce antenna harmonic response to improve radiated emissions, adjust antenna impedance and quality factor (Q) to optimize for a radio transceiver, and/or maintain desired antenna physical aperture, gain and efficiency, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
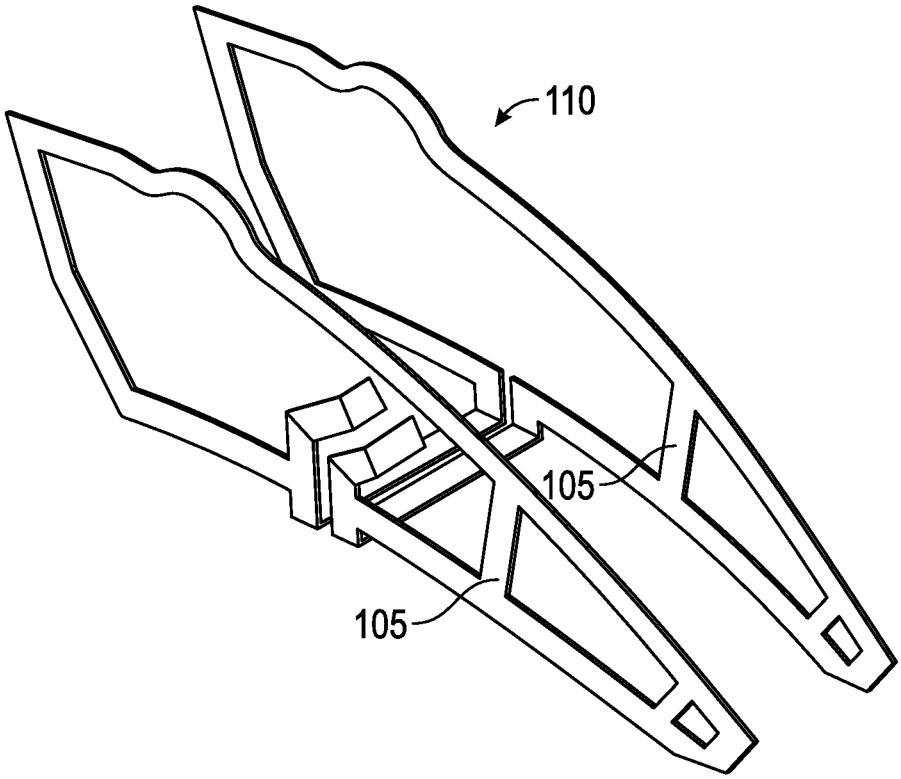
FIGS. 1A-1B illustrate three-dimensional views of an antenna with a shorting conductor for a hearing assistance device, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Disclosed herein, among other things, are methods and apparatus for mitigating antenna interference for hearing assistance devices. One aspect of the present subject matter includes a hearing assistance device, such as a hearing aid, for a wearer including hearing assistance electronics and an antenna including a loop segment. According to various embodiments, one or more conductors are connected in parallel with a portion of the loop segment. The conductors electrically short the loop segment to change current distribution in the antenna. The conductors are further configured to increase desired coupling, adjust antenna frequency response, adjust electric field distribution, adjust magnetic field distribution, reduce antenna harmonic response to improve radiated emissions, adjust antenna impedance and quality factor (Q) to optimize for a radio transceiver, and/or maintain desired antenna physical aperture, gain and efficiency, in various embodiments.

In various embodiments, adding shorting conductor(s) changes the shape of the current path(s) and concentration of antenna currents, which can be used to make changes in antenna impedance, antenna frequency response, and in electric and magnetic field distributions. The problem of reducing unwanted coupling between the hearing aid electronics and the antenna is only one of the problems that can be solved by adding one or more shorting conductors of the present subject matter. Other problems can be solved by adding shorting bars or conductors of the desired shape in the desired location. In one example, the sorting conductors are configured to change the antenna frequency response. If a hearing aid antenna is not meeting radiated emissions regulatory requirements because it is radiating too much power at certain out-of-band frequencies, such as at harmonics of the fundamental operating frequency, the antenna gain or radiation efficiency can be reduced at the unwanted (out-of-band) frequency or frequencies relative to the fundamental (operating) frequency by adding one or more shorting conductors of the present subject matter. Thus, the unwanted emitted power level is reduced to meet the regulatory limits. In another example, the shorting conductors are configured to change the antenna impedance to achieve a desired impedance match with the RF circuit. In another example, the shorting conductors are configured to increase desired coupling rather than decrease unwanted coupling. In other examples, the shorting conductors are configured to achieve a desired combination of changes to antenna impedance, antenna frequency response, and electromagnetic field distributions, or other combinations, to solve more than one problem.

Figure 1B:
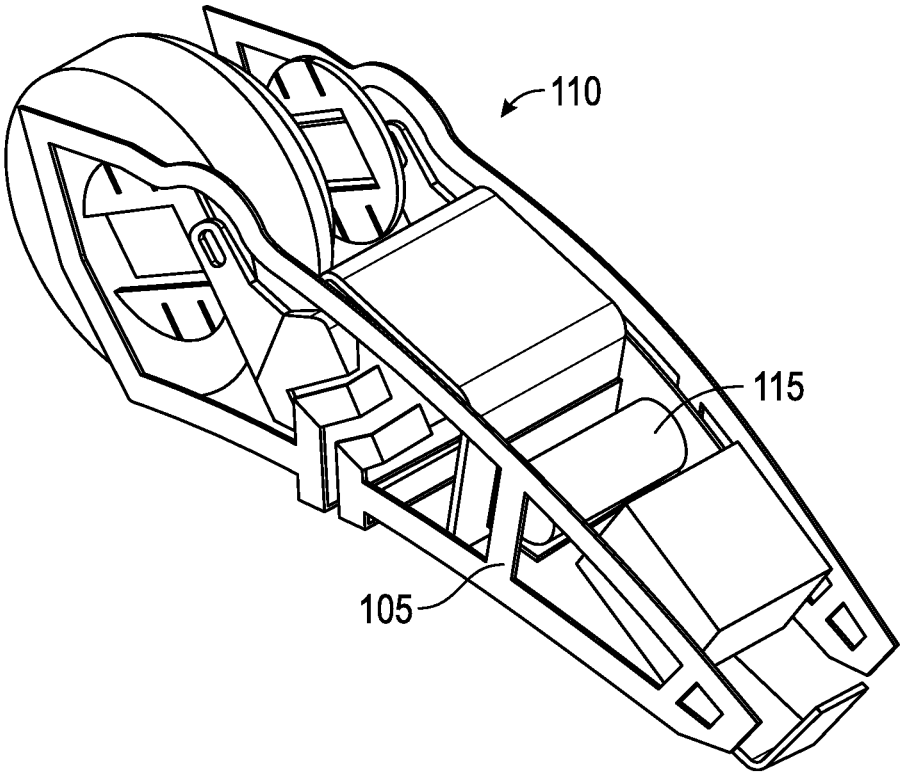

FIGS. 1A-1B illustrate cross-sectional views of an antenna with a shorting conductor for a hearing assistance device, according to various embodiments of the present subject matter. According to various embodiments, current flow in antenna loops 110 is changed by selectively placing one or more conductors 105 in parallel with portions of one or more loop segments, creating a shorter path that some of the current follows. Loop 110 is one of two or more parallel antenna loops, in an embodiment. By adding a conductor 105, the current distribution on the antenna is changed to reduce coupling to hearing assistance electronics such as a telecoil 115. Significant improvement in audible performance is achieved using the present subject matter while maintaining comparable radio frequency (RF) effective radiated power. For example, at 900 MHz, an antenna has a real portion of impedance of 3.98 ohms. The same antenna, when using a shorting conductor of the present subject matter, exhibits a real portion of impedance of 2.24 ohms and a 0.4 dB increase in radiation efficiency. In addition, the present subject matter reduces audio artifacts without reducing antenna gain or changing the hearing aid size in various embodiments.

Figure 2:
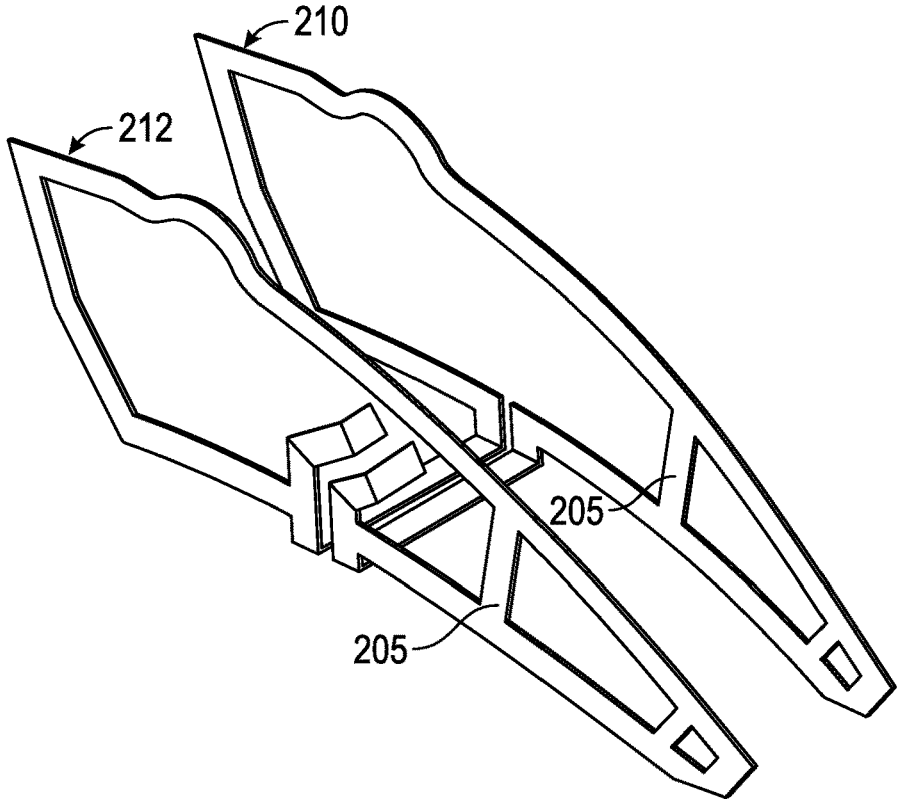
FIG. 2 illustrates a three-dimensional electromagnetic field simulation for an antenna, according to various embodiments of the present subject matter.
Figure 3:
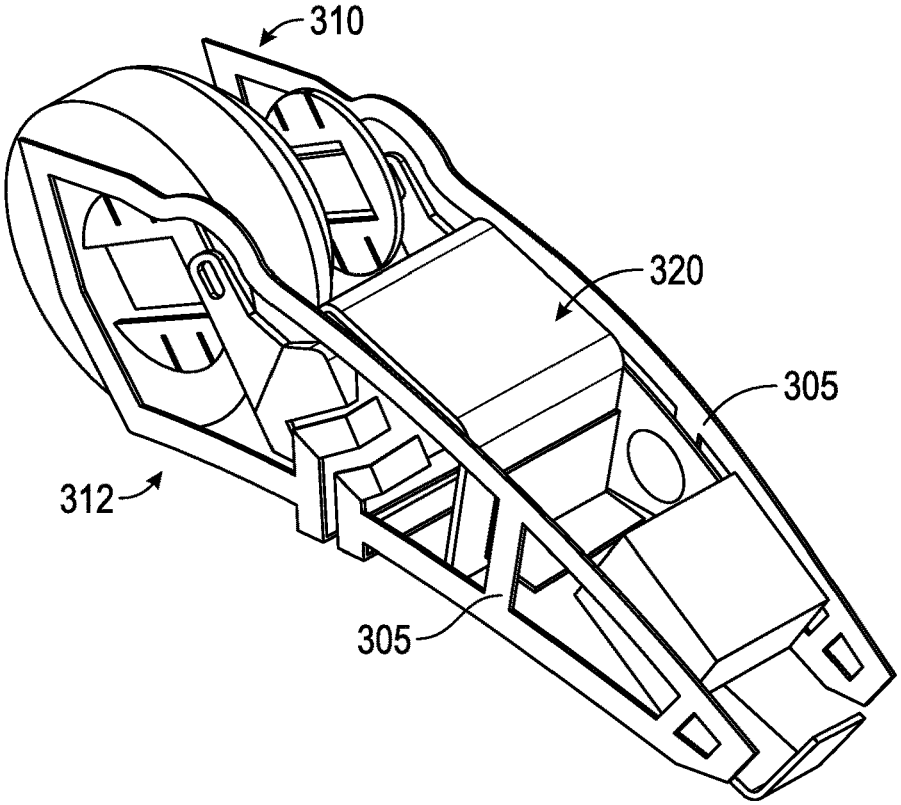
FIG. 3 illustrates a three-dimensional electromagnetic field simulation for a hearing assistance device, according to various embodiments of the present subject matter.

FIG. 2 illustrates a three-dimensional electromagnetic field simulation for an antenna, according to various embodiments of the present subject matter. According to various embodiments, current flow in a first antenna loop 210 is changed by selectively placing one or more conductors 205 in parallel with portions of one or more loop segments, creating a shorter path that some of the current follows. In addition, current flow in a second antenna loop 212 is changed by selectively placing one or more conductors 205 in parallel with portions of one or more loop segments FIG. 3 illustrates a three-dimensional electromagnetic field simulation for a hearing assistance device, according to various embodiments of the present subject matter. According to various embodiments, current flow in a first antenna loop 310 is changed by selectively placing one or more conductors 305 in parallel with portions of one or more loop segments, creating a shorter path that some of the current follows. In addition, current flow in a second antenna loop 312 is changed by selectively placing one or more conductors 305 in parallel with portions of one or more loop segments. By adding one or more of the conductors 305, the current distribution on the antenna is changed to reduce coupling to hearing assistance electronics 320.

Figure 4A:
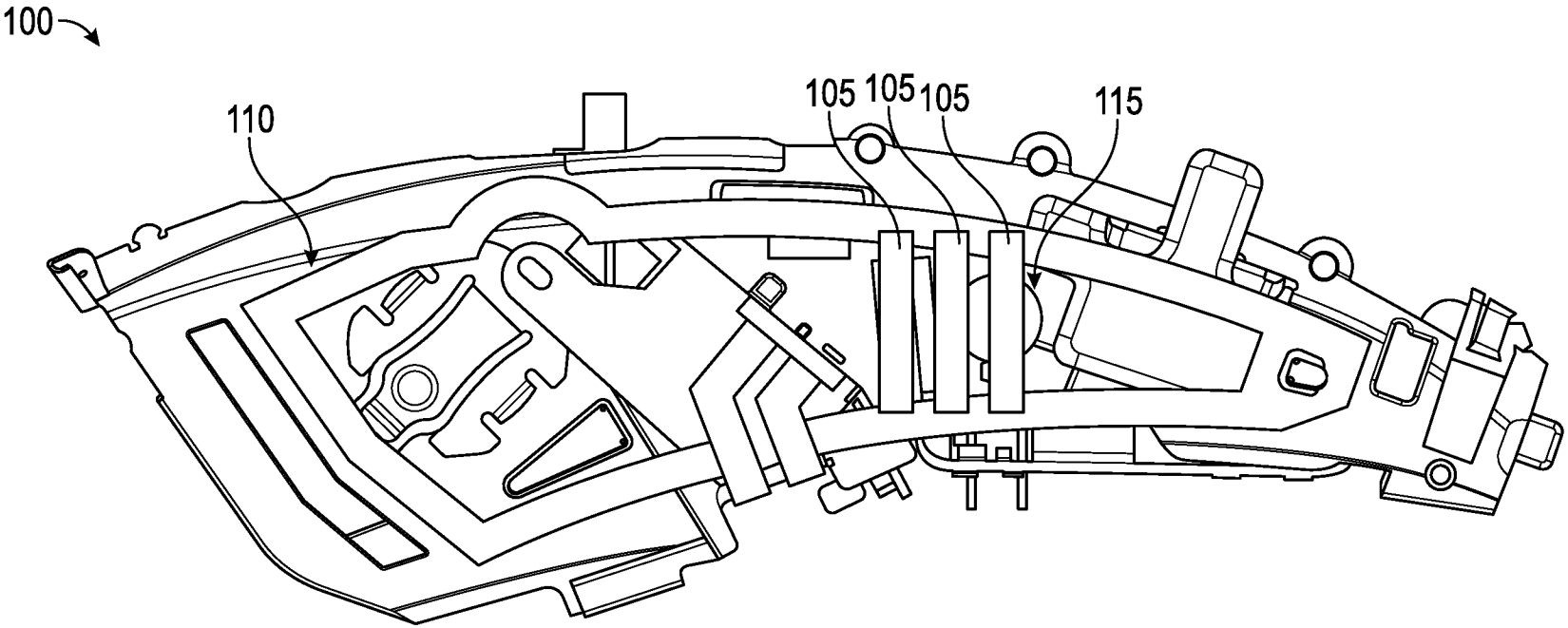
FIGS. 4A-4B illustrate cross-sectional views of an antenna with multiple shorting conductors for a hearing assistance device, according to various embodiments of the present subject matter.
Figure 4B:
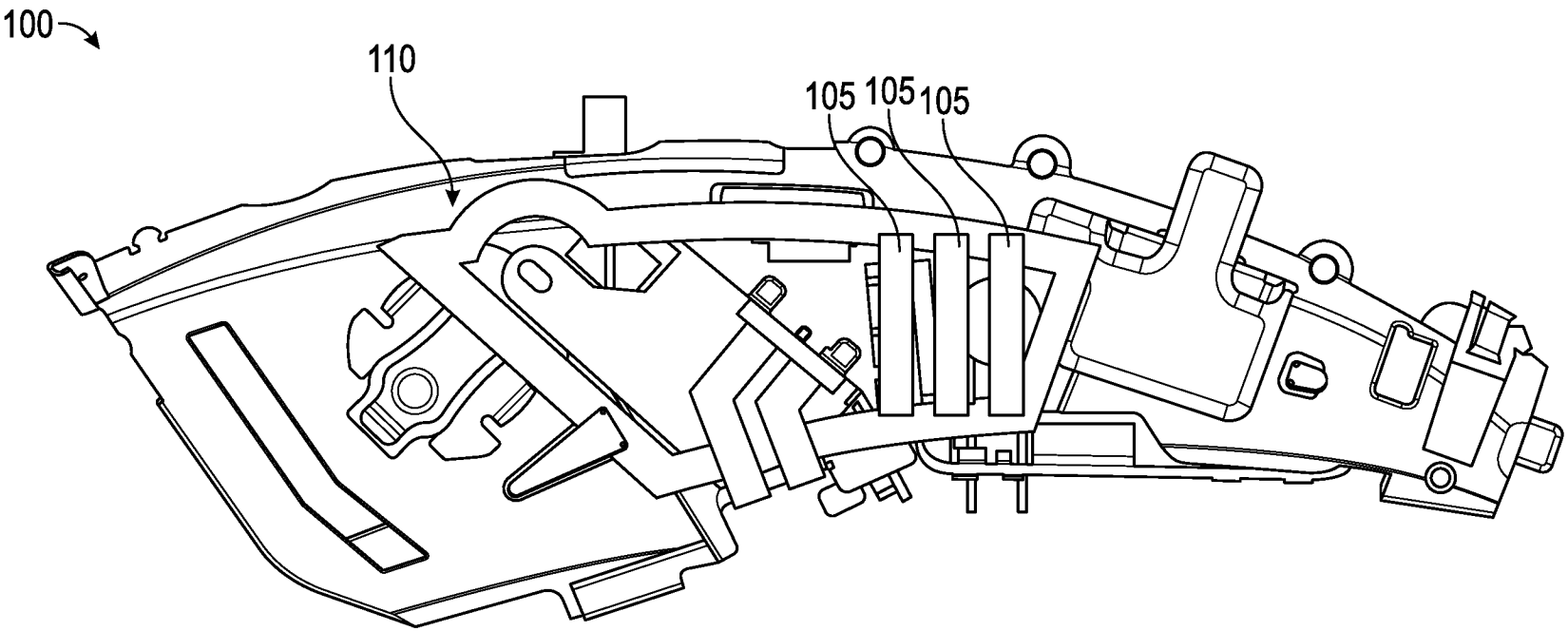

The three-dimensional electromagnetic field simulations of FIGS. 2-3 show that most of the current flows through the shorting bar, but there is some current that flows in the structure which has been shorted out. This explains why gain and radiation efficiency performance can remain similar to that of the un-shorted loop. If the portions of the structure which have been shorted out were removed, the effective aperture, gain and efficiency would be significantly reduced. The results of these simulations show that improved antenna harmonic response can be realized with selective inclusion of shorting conductors to control where and how much current flows on the antenna conductor or conductors, in various embodiments FIGS. 4A-4B illustrate cross-sectional views of an antenna with multiple shorting conductors for a hearing assistance device 100, according to various embodiments of the present subject matter. According to various embodiments, current flow in antenna loops 110 is changed by selectively placing one or more conductors 105 in parallel with portions of one or more loop segments, creating a shorter path that some of the current follows. Loop 110 is one of two or more parallel antenna loops, in an embodiment. By adding multiple conductors 105, the current distribution on the antenna is changed to reduce coupling to hearing assistance electronics such as a telecoil 115.

Other embodiments are possible without departing from the scope of the present subject matter. For example, one or more shorting conductors can be placed in each of one or more loops. In various embodiments, shorting conductor widths can be varied to vary the amount of current through the conductors. Shorting conductor sections could be curved, follow split or meandered paths, in various embodiments. In various embodiments, antennas with multiple loops can have the same or different shorting conductor configurations applied to each individual loop. Shorting conductors can be used in band-style loops or hybrid combinations, in various embodiments. The present subject matter can be implemented in antennas with flex, wires, metal-on-plastics, conductive printing and other fabrication methods that can create current loops with shorting conductors, according to various embodiments. In one embodiment, capacitively coupled fingers can be used in place of the shorting conductors. The present subject matter provides for smaller, better performing wireless hearing assistance devices.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid for a wearer, comprising:

hearing aid electronics;

an antenna including multiple loop segments; and a plurality of conductors, each of the conductors electrically connected in parallel with a selectable portion of at least one of the loop segments, at least one of the plurality of conductors electrically shorting at least one of the loop segments to adjust antenna impedance, antenna frequency response, and electric and magnetic field distribution including reducing radiation emissions of the antenna at out-of-band frequencies to reduce transmitter harmonic radiation by changing current distribution in the antenna by adjusting placement and size of the at least one of the plurality of conductors, wherein each of the multiple loop segments includes a different shorting conductor shape.

2. The hearing aid of claim 1, wherein at least one of the one or more conductors is configured to reduce unwanted coupling between the hearing aid electronics and the antenna by changing current distribution in the antenna.

3. The hearing aid of claim 1, wherein at least one of the one or more conductors is configured to adjust antenna frequency response by changing current distribution in the antenna.

4. The hearing aid of claim 1, wherein at least one of the one or more conductors is configured to adjust antenna impedance by changing current distribution in the antenna.

5. The hearing aid of claim 1, wherein at least one of the one or more conductors is configured to adjust electric field distribution by changing current distribution in the antenna.

6. The hearing aid of claim 1, wherein at least two of the multiple loop segments include different shorting conductor configurations.

7. The hearing aid of claim 1, wherein one or more conductors are configured in parallel with each of the multiple loop segments.

8. The hearing aid of claim 1, wherein a width of the one of the one or more conductors is varied to adjust current flowing through the antenna.

9. The hearing aid of claim 1, wherein at least one of the one or more conductors is curved.

10. The hearing aid of claim 1, wherein at least one of the one or more conductors follows a split path.

11. A method for making an antenna for a hearing aid, the method comprising:

connecting each of a plurality of conductors electrically in parallel with a selectable portion of at least one segment of multiple loop segments of the antenna, including electrically shorting at least one of the loop segments to adjust antenna impedance, antenna frequency response, and electric and magnetic field distribution including reducing radiation emissions of the antenna at out- of-band frequencies to reduce transmitter harmonic radiation by changing current distribution in the antenna by adjusting placement and size of at least one of the plurality of conductors, wherein each of the multiple loop segments includes a different shorting conductor shape.

12. The method of claim 11, wherein connecting the conductor is performed during manufacture of the antenna.

13. The method of claim 11, wherein connecting the conductor is performed during assembly of the hearing assistance device.

14. The method of claim 11, wherein the antenna includes a flex circuit.

15. The method of claim 11, wherein the antenna includes a hybrid circuit.

16. The method of claim 11, wherein the conductor includes a capacitively coupled finger.

17. The method of claim 11, wherein connecting the conductor includes using a wire.

18. The method of claim 11, wherein connecting the conductor includes using metal- on-plastics.

19. The method of claim 11, wherein connecting the conductor includes using conductive printing.

* * * * *